US005513563A

United States Patent [19]

Berson

[11] Patent Number: 5,513,563

[45] Date of Patent: May 7, 1996

[54] INDICIA SECURITY VIA VARIABLE DOT SIZE

[75] Inventor: William Berson, Weston, Conn.

[73] Assignee: Pitney Bowes Inc., Stamford, Conn.

[21] Appl. No.: 339,049

[22] Filed: Nov. 14, 1994

[51] Int. Cl.[6] ..... B41J 2/01

[52] U.S. Cl. ..... 101/91; 400/124.30; 347/15; 382/299; 364/408; 235/101

[58] Field of Search ..... 101/71, 91; 400/103, 400/104, 124.02, 124.04, 124.30; 235/101; 347/14, 15; 364/408, 464.01, 464.02, 918.52, 930–930.7; 382/298, 299, 300, 301; 395/107, 108, 109, 110

[56] References Cited

U.S. PATENT DOCUMENTS

| | | | |
|---|---|---|---|
| 4,386,272 | 5/1983 | Check, Jr. et al. | 250/236 |
| 4,428,284 | 1/1984 | Thorne | 101/93.04 |
| 4,455,562 | 6/1984 | Dolan et al. | 346/154 |
| 4,493,252 | 1/1985 | Clark | 101/7.1 |
| 4,513,299 | 4/1985 | Lee et al. | 347/15 |
| 4,637,051 | 1/1987 | Clark | 382/1 |
| 4,641,346 | 2/1987 | Clark et al. | 235/101 |
| 4,660,221 | 4/1987 | Dlugos | 380/23 |
| 4,739,343 | 4/1988 | Dolan | 101/71 |
| 4,808,832 | 2/1989 | Doggett | 250/548 |
| 5,181,245 | 1/1993 | Jones | 280/23 |
| 5,202,834 | 4/1993 | Gilham | 364/464.02 |
| 5,233,657 | 8/1993 | Gunther | 380/23 |

FOREIGN PATENT DOCUMENTS

| | | | |
|---|---|---|---|
| 58-007370 | 1/1983 | Japan | 400/124 WD |
| 59-055760 | 3/1984 | Japan | 400/124.3 |
| 60-259461 | 12/1985 | Japan | 400/124 WD |
| 3-234546 | 10/1991 | Japan | 400/124.3 |

*Primary Examiner*—David A. Wiecking

*Attorney, Agent, or Firm*—Ronald Reichman; Melvin J. Scolnick

[57] ABSTRACT

A system is disclosed that makes it more difficult to print fraudulent indicia. Security is achieved by varying the dot size of pixels in the printed image according to a predetermined arrangement.

5 Claims, 3 Drawing Sheets

INDICIA SECURITY VIA VARIABLE DOT SIZE

FIELD OF THE INVENTION

This invention pertains to printers which print characters composed of dots and more particularly to printers that are controlled electronically to print characters of variable dot size.

DESCRIPTION OF THE PRIOR ART

Since the issuance of U.S. Pat. No. 1,530,852 to Arthur H. Pitney, Mar. 24, 1925, the postage meter has had a steady evolution. Each meter had a printer included therein on a one-to-one basis, i.e. one metering device and one printing device incorporated into a unit. In postage meters, the need for security is absolute. Such security is applied in prior postage meters both to the printing portion of the meter and the accounting portion. The reason for the need of absolute security is because a postage meter is printing value, and unless security measures are taken, one would be able to print unauthorized postage, i.e. postage for which no payment is made, thereby defrauding the postal service.

Printers that print characters in the form of dots have been utilized in postage meters. The aforementioned printers form characters from a matrix of dots. Unlike the face character printing methods, the printing elements are organized in columns or rows which print dots. A character in a dot printer is formed sequentially by printing at one time either all the selected dots, respectively in a column or a row. Graphics are made possible by precisely positioning dots on a page.

Although postage meters have performed satisfactorily in the past, and continue to perform satisfactorily, with the advancement of technology it is becoming easier to print fraudulent indicia.

SUMMARY OF THE INVENTION

This invention overcomes the disadvantages of the prior art by providing a system that makes it more difficult to print fraudulent indicia. The apparatus of this invention provides a device for verifiable security in a postage meter or other device using dot matrix or bit-addressable printing. Security is achieved by varying the dot size of pixels in the printed image according to a predetermined arrangement. The dot size variation is used to encode the meter serial number, ascending and descending funds registers, mail piece identifier date, time and origin of mail piece and other data which may be used for indicia variation and to prevent fraud.

DETAILED DESCRIPTION OF THE PREFERRED EMBODIMENT

Figure 1:
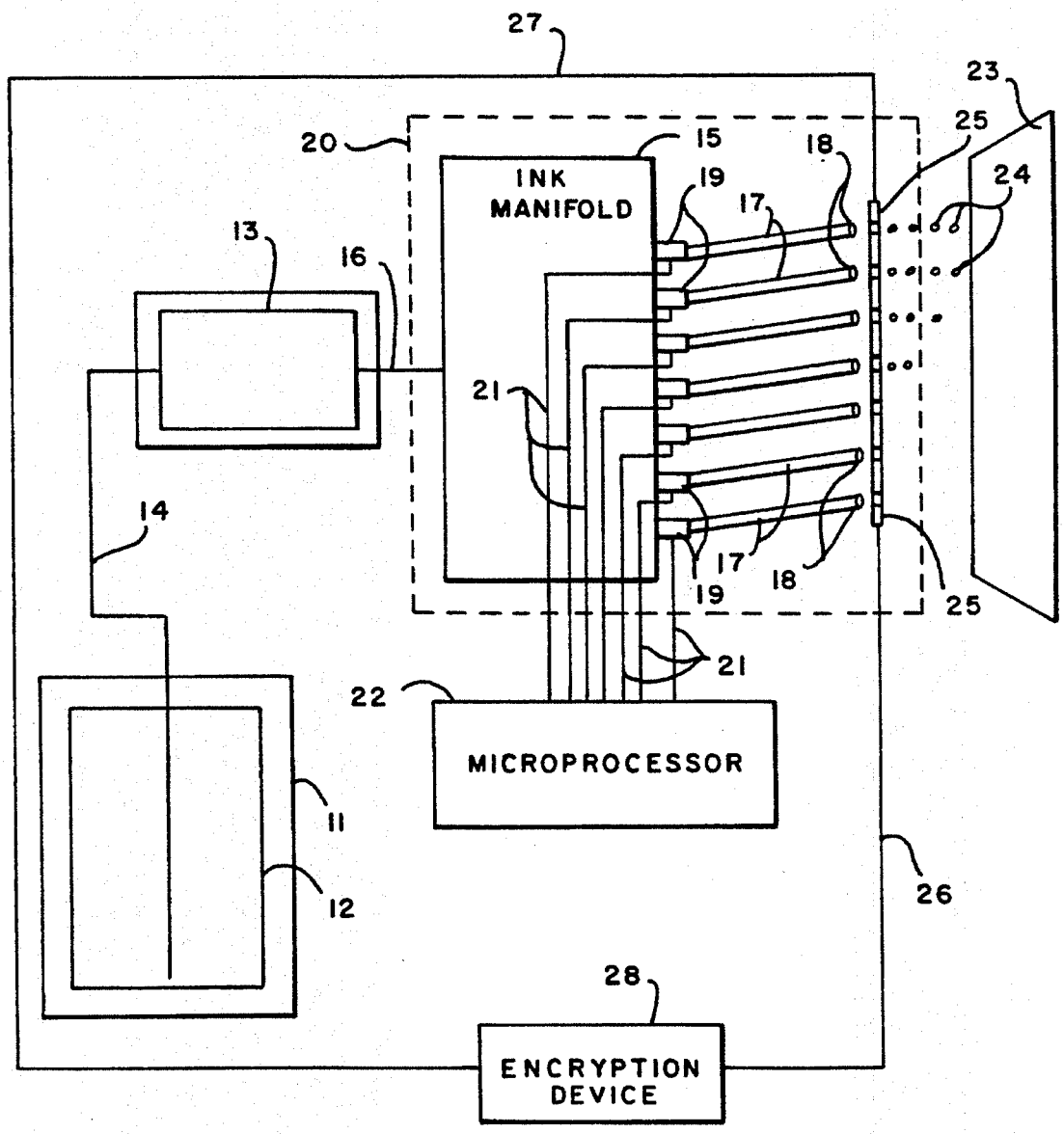
FIG. 1 is a drawing of the apparatus of this invention.

Referring now to the drawings in detail, and more particularly to FIG. 1, the reference character 11 represents an ink cartridge containing ink 12 therein. Cartridge 11 is connected to an ink filter 13 by means of conduit 14. Ink filter 13 is connected to an ink manifold 15 by means of conduit 16. A plurality of generally vertically spaced capillary tubes 17 are confluent with the manifold 15 and have orifices or nozzles 18 at one end thereof and transducers or piezoelectric devices 19 at the other end thereof. A deflection plate or drop array 25 is placed in front of apertures 18. The other end of array 25 is connected to microcomputer 22. The ink manifold 15, capillary tubes 17, nozzles 18, piezoelectric devices 19 and drop array 25, define a print head 20. A plurality of electrical leads 21 are connected to the piezoelectric devices 19 there being one lead for each piezoelectric device 19. The electrical leads 21 are connected to a microcomputer 22. The microcomputer 22 will control piezoelectric devices 19 to propel drops of ink 24 through capillary tubes 17, through nozzles 18 onto printing medium or writing surface 23. Thus, ink drops 24 can be released from nozzles 18 on demand. Ejection is by means of shock waves from piezoelectric devices 19 which momentarily increases the pressure of nozzles 18.

Ink drops 24 are of uniform size and spacing, both being a function of the pressure at nozzles 18, the viscosity and surface tension of the ink of the ink, the diameter of nozzles 18, the surface energy of the nozzle material, and the vibration frequency of nozzles 18. Each drop of ink 24 may be given a precise electrostatic charge by drop array 25. The size of ink drops 24 and consequently the dot size that appears on writing surface 23 may be varied by varying the driving voltage of drop array 25. One end of lead 26 is connected o to drop array 25 and the other end of lead 26 is connected to encryption device 28. One end of lead 27 is connected to drop array 25 and the other end of lead 27 is connected to encryption device 28. The stream of controlled varying size ink droplets 24 will form character or graphics on writing surface 23.

Figure 2:
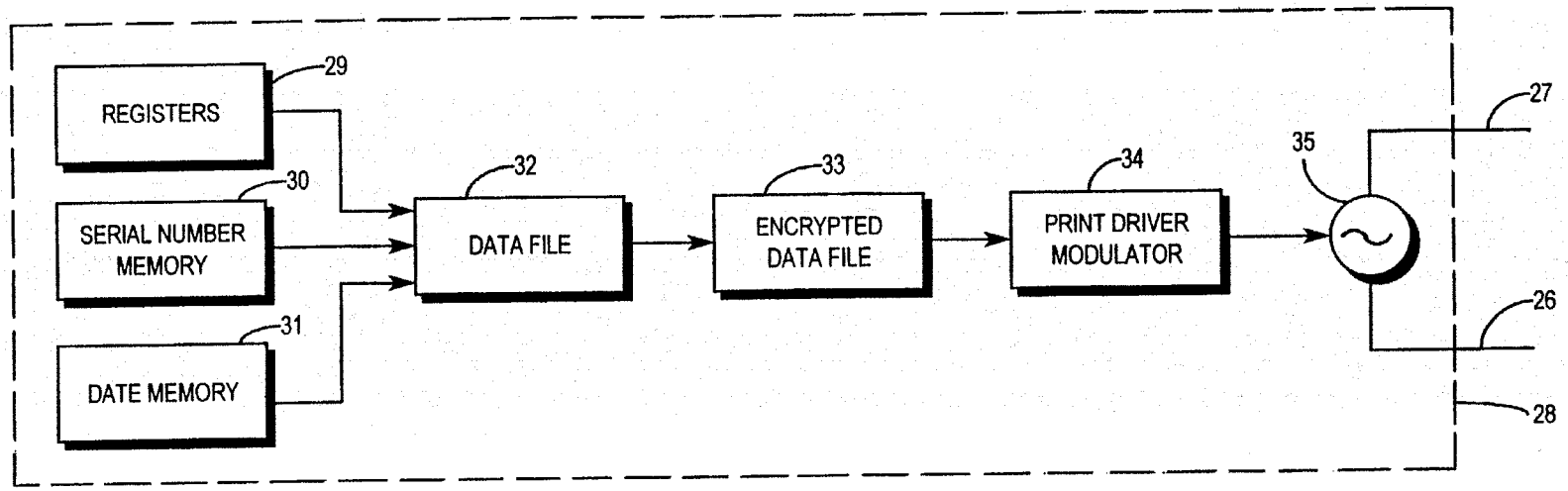
FIG. 2 is a block drawing of encryption device 28 of FIG. 1 in greater detail.

FIG. 2 is a drawing that shows encryption device 28 of FIG. 1 in greater detail. The postage used by a particular postal meter and the postage remaining to be used for a particular postage meter will be contained in registers 29. The serial number of a particular postage meter will be stored in serial number memory 30 and the date that an indicia is affixed to a particular mail piece will be stored in date memory 31. The output of registers 29, serial number 30 and date memory 31 are individually coupled to the input of data file 32. Data file 32 stores its inputted data and outputs the stored data to the input of encrypted data file 33. Data file 32 encrypts its inputted data and transmits the encrypted data to the input of print head driver voltage 34. The output of driver 34 will be a sequence of voltages that represent a sequency of dots of varying diameters. The operation of driver 34 will be described in the description of FIG. 3. The output of driver 34 is coupled to the input of voltage source 35 and the output of voltage source 35 is coupled to array 25 by leads 26 and 27.

Figure 3:
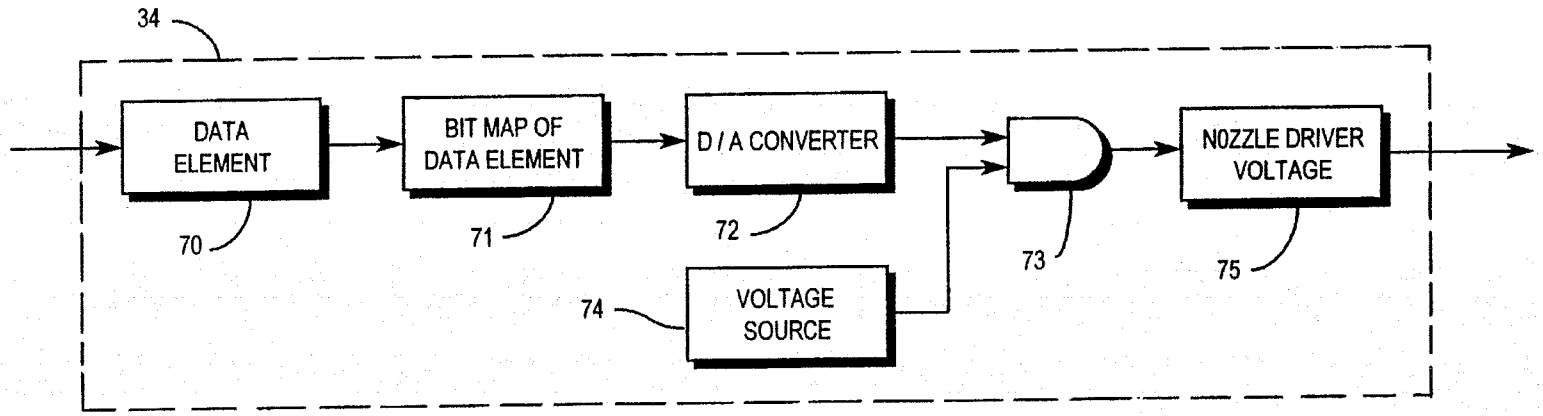
FIG. 3 is a block drawing of driver modulator 34 of FIG. 2 in greater detail.

FIG. 3 is a block drawing that shows driver 34 of FIG. 2 in greater detail. Driver 34 comprises: data element 70; bit map of data element 71, digital to analog converter 72; and gate 73; voltage source 74; and nozzle driver voltage 75. Data element 70 receives serially one byte at a time encrypted data from file 72. Element 70 processes the aforementioned encrypted data by obtaining is a bit by bit representation of the data. The aforementioned bit by bit representation of the data is inputted to map 71, where it is temporarily stored. The output of map 71 is coupled to the input of D/C converter 72. D/A converter 72 converts its digital inputs into an analog signal, which is coupled to one of the inputs of and gate 73. The second input to gate 73 is the output of nozzle bias voltage source 74. Gate 73 will be enabled when it receives an input from D/A converter 72 and voltage source 74. The output of gate 73 will cause driver 75 to have an output voltage.

Figure 4:
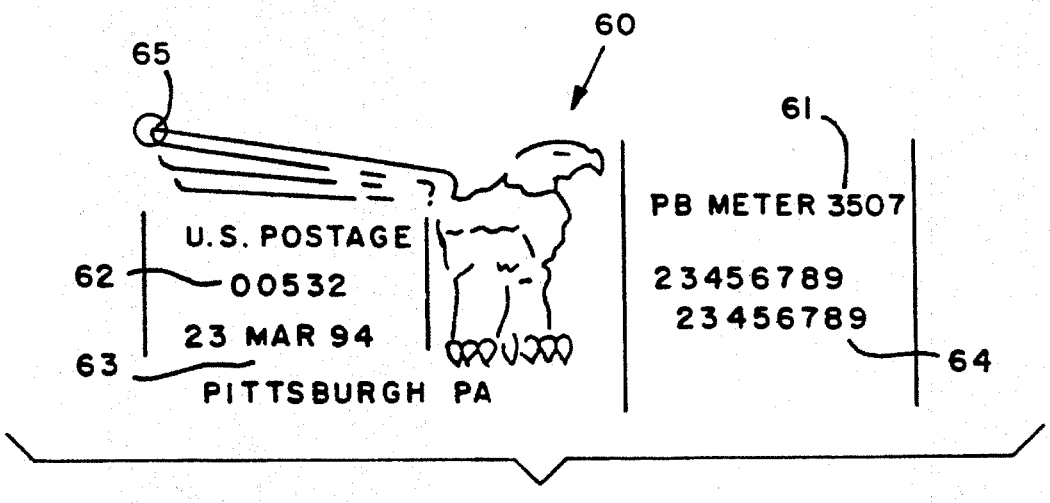
FIG. 4 is a drawing of an indicia in which print head 20 has imprinted the postal information thereon.

FIG. 4 is a drawing of an indicia in which print head 20 has imprinted the postal information thereon. The document 60 will have an indicia that contains a dollar amount 62, the date the indicia was affixed to the mail piece 63, and the postal meter serial number 61. In addition, the document 60 will include a validation number 64.

Figure 5:
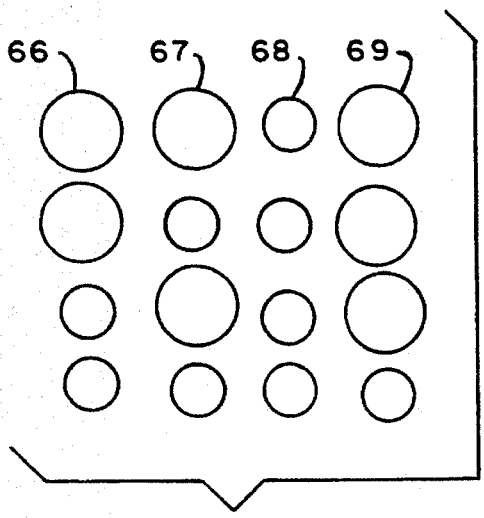
FIG. 5. is a drawing of an expanded view of portion 65 of the indicia shown in FIG. 4.

FIG. 5 is an expanded view of portion 65 of the indicia shown in FIG. 4. The postal meter serial number 61 which was represented by the number 3507 in FIG. 4 would be represented in binary coded decimal in memory 30 (FIG. 2) as 0011 0101 0000 0111 and may be encrypted by data file 33 as 1100 1010 0000 1110. The encrypted serial number 1100 1010 0000 1110 may be printed in portion 65 of the indicia shown in FIG. 4 with dots having different diameters. A large dot would represent a binary one and a small dot would represent a binary zero. The number 1100 is shown in column 66 and the number 1010 is shown in column 67. The number 0000 is shown in column 68 and the number 1110 is shown in column 69. The data that represents the serial number 61 was encrypted into a conventional mail piece by varying the dot size of the dots that comprise the indicia.

The above specification describes a new and improved apparatus for providing security to printed indicia by varying the dot size of the dots that comprise the indicia. It is realized that the above description may indicate to those skilled in the art additional ways in which the principals of this invention may be used without departing from the spirit. It is, therefore, intended that this invention be limited only by the scope of the appended claims.

What is claimed is:

1. A postal meter printer for printing alphanumeric characters and indicia on a plurality of mail pieces, said printer comprises:

means for printing a plurality of dots that represent the alphanumeric characters and indicia;

means for storing specific information about the postal meter and the plurality of mail pieces;

means coupled to said storing means for developing one or more codes that contain information about the postal meter and the plurality of mail pieces; and means coupled to said developing means and said printing means for varying the dot size on specific printed regions of the plurality of mail pieces so that said one or more printed regions of the mail piece containing varying dot sizes will be coded in accordance with the code produced by said developing means without changing the identity of the alphanumeric characters and indicia.

2. The printer claimed in claim 1, wherein said printing means comprises:

means for holding ink;

means coupled to said holding means for placing drops of ink that represent dots on the mail pieces.

3. The printer claimed in claim 2, wherein said placing means comprises:

a tube in which ink flows coupled to said holding means;

means coupled to said tube for ejecting discrete quantities of ink from said tube;

means coupled to said ejecting means for supplying an electric charge to the quantities of ink to determine the size of the dots that represent alphanumeric characters and indicia.

4. The printer claimed in claim 3, wherein said ejecting means is a piezoelectric device.

5. The printer claimed in claim 4, wherein said supplying means is a deflection plate.

* * * * *